United States Patent [19]

Mäder

[11] Patent Number: 5,058,483

[45] Date of Patent: Oct. 22, 1991

[54] CARTRIDGE FEED MECHANISM FOR AN AUTOMATIC FIREARM

[75] Inventor: Helmut Mäder, Schramberg, Fed. Rep. of Germany

[73] Assignee: Mauser-Werke Oberndorf GmbH, Obernodorf, Fed. Rep. of Germany

[21] Appl. No.: 491,347

[22] Filed: Mar. 9, 1990

[30] Foreign Application Priority Data

Mar. 10, 1989 [DE] Fed. Rep. of Germany ..... 3907759

[51] Int. Cl.[5] ..... F41A 9/30

[52] U.S. Cl. ..... 89/33.25

[58] Field of Search ..... 89/33.16, 33.17, 33.25, 89/33.04

[56] References Cited

U.S. PATENT DOCUMENTS

| | | | |
|---|---|---|---|
| 3,296,930 | 1/1967 | Rocha | 89/33.25 |
| 4,223,589 | 9/1980 | Post | 89/33.04 |
| 4,292,881 | 10/1981 | Hupp et al. | 89/33.25 |
| 4,348,938 | 9/1982 | Gillum | 89/33.17 |

FOREIGN PATENT DOCUMENTS

| | | | |
|---|---|---|---|
| 1231594 | 12/1966 | Fed. Rep. of Germany | 89/33.17 |
| 2825091 | 3/1983 | Fed. Rep. of Germany | 89/33.25 |
| 355767 | 2/1930 | United Kingdom | 89/33.17 |

*Primary Examiner*—Deborah L. Kyle
*Assistant Examiner*—Stephen Johnson
*Attorney, Agent, or Firm*—McGlew & Tuttle

[57] ABSTRACT

A cartridge feed mechanism of an automatic firearm is mounted pivotably on a drive housing. In the pivoted-up position, a coupling tongue 15 of the transmission shaft 9 of the cartridge feed mechanism engages with a coupling groove of a drive sleeve of the drive housing. The coupling tongue shall be prevented from rotating when the cartridge feed mechanism is pivoted down from the drive housing. For this purpose, a slide 16, which locks the transmission shaft 9 in a locking position and releases it in a releasing position, is mounted on the cartridge feed mechanism. Slide 16 is pressed by the drive housing into its releasing position when the cartridge feed mechanism is in the pivoted-up position. In the pivoted-down position of the cartridge feed mechanism, it is brought into its locking position by a compression spring.

5 Claims, 2 Drawing Sheets

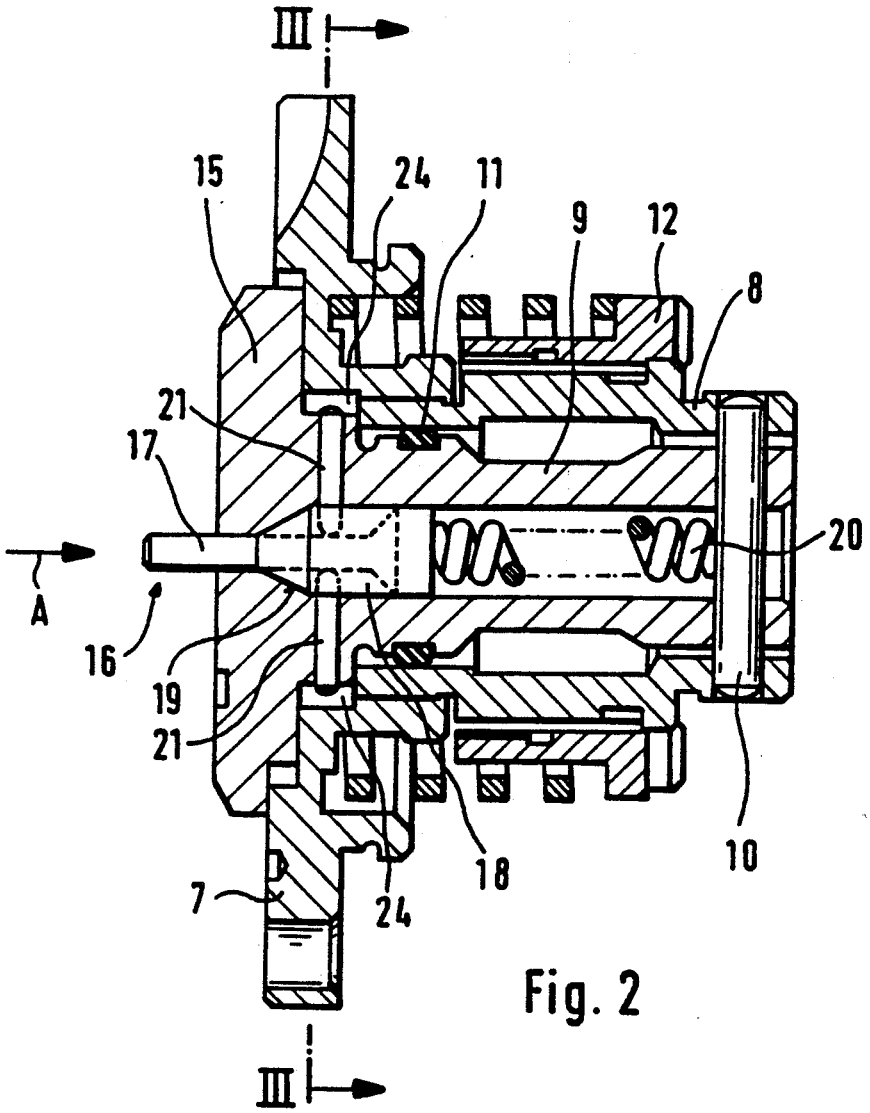
Fig. 2
Fig. 3
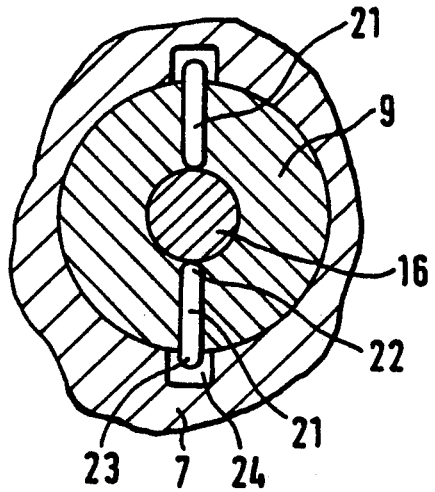

CARTRIDGE FEED MECHANISM FOR AN AUTOMATIC FIREARM

FIELD AND BACKGROUND OF THE INVENTION

The present invention pertains to a cartridge feed mechanism for an automatic firearm, wherein the cartridge feed mechanism is mounted pivotably on a drive housing and a drive sleeve with a coupling groove mounted in the drive housing and a transmission shaft with a coupling tongue is mounted in the cartridge feed mechanism. The coupling tongue engages with the coupling groove in a pivoted-up position of the cartridge feed mechanism and is disengaged from the coupling groove in the pivoted-down position of the cartridge feed mechanism.

Such a cartridge feed mechanism is described in West German Pat. Specification No. 28,25,091. In this prior-art cartridge feed mechanism, the transmission shaft is free when the cartridge feed mechanism is pivoted away from the drive housing. In cases of malfunction, it is necessary to wind the ammunition to and fro at the cartridge feed mechanism. The transmission shaft may then also rotate now. This is unfavorable, because if the cartridge feed mechanism is to be pivoted again to the drive housing, the coupling tongue may be located in a rotated position relative to the coupling groove, in which position it is unable to engage with the coupling groove.

SUMMARY AND OBJECTS OF THE INVENTION

It is an object of the present invention to provide a cartridge feed mechanism arrangement of the type mentioned in the introduction, in which the transmission shaft is prevented from rotating when th cartridge feed mechanism is pivoted off from the drive housing.

According to the present invention, a cartridge feed mechanism of the type mentioned in the introduction is provided in which there is mounted o the cartridge feed mechanism a slide which locks the transmission shaft in a locking position and releases the transmission shaft in a releasing position. The slide is pressed by the drive housing into its releasing position when the cartridge feed mechanism is in its pivoted-up position and is in its locking position when the cartridge feed mechanism is in its pivoted-off position.

According to this arrangement, when the cartridge feed mechanism is pivoted off from the drive housing, the coupling tongue of the transmission shaft will always stop in the position in which it will again fit into the coupling groove when the cartridge feed mechanism is subsequently pivoted to the drive housing. This facilitates the operation, because when pivotinq the cartridge feed mechanism up, the shooter does not need to check whether the coupling tongue and the coupling groove are in a positions suitable for engagement.

The cartridge feed mechanism, according to the invention, is mounted pivotably on a drive housing and may be pivoted into connection and pivoted off the drive housing. A drive sleeve having a coupling groove is mounted in the drive housing with the coupling groove facing the cartridge feed mechanism. A transmission shaft provided with a coupling tongue is mounted in the cartridge feed mechanism. The coupling tongue engages the coupling groove in the pivoted-up position or connection position of the cartridge feed mechanism and the drive housing. The coupling tongue is disengaged from the coupling groove in the pivoted-down position or disengaged position of the cartridge feed mechanism and the drive housing. Slide locking means is provided locking the transmission shaft in position and releasing the transmission shaft. The slide locking mechanism is actuated by said drive housing pushing said drive locking means into a releasing position upon the cartridge feed mechanism reaching its pivoted-up position (connected position). The slide locking mechanism locks the cartridge feed mechanism in its locking position upon the cartridge feed mechanism moving into a pivoted-down position (unconnected position).

In a preferred embodiment of the present invention, the slide can be brought into its locking position by means of a spring arranged in the cartridge feed mechanism. It is thus achieved that when the cartridge feed mechanism is pivoted down from the drive housing, the slide will move into its locking position by itself. It is not necessary to provide any means on the drive housing for bringing the slide into the locking position.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred

BRIEF DESCRIPTION OF THE DRAWINGS

In the drawings:

FIG. 2 shows the sectional view of the improved part of the cartridge feed mechanism according to the present invention, and FIG. 3 shows a section through the improved part of the cartridge feed mechanism with slide along the line III—III in FIG. 2.

DETAILED DESCRIPTION OF THE PREFERRED EMBODIMENT

Figure 1:
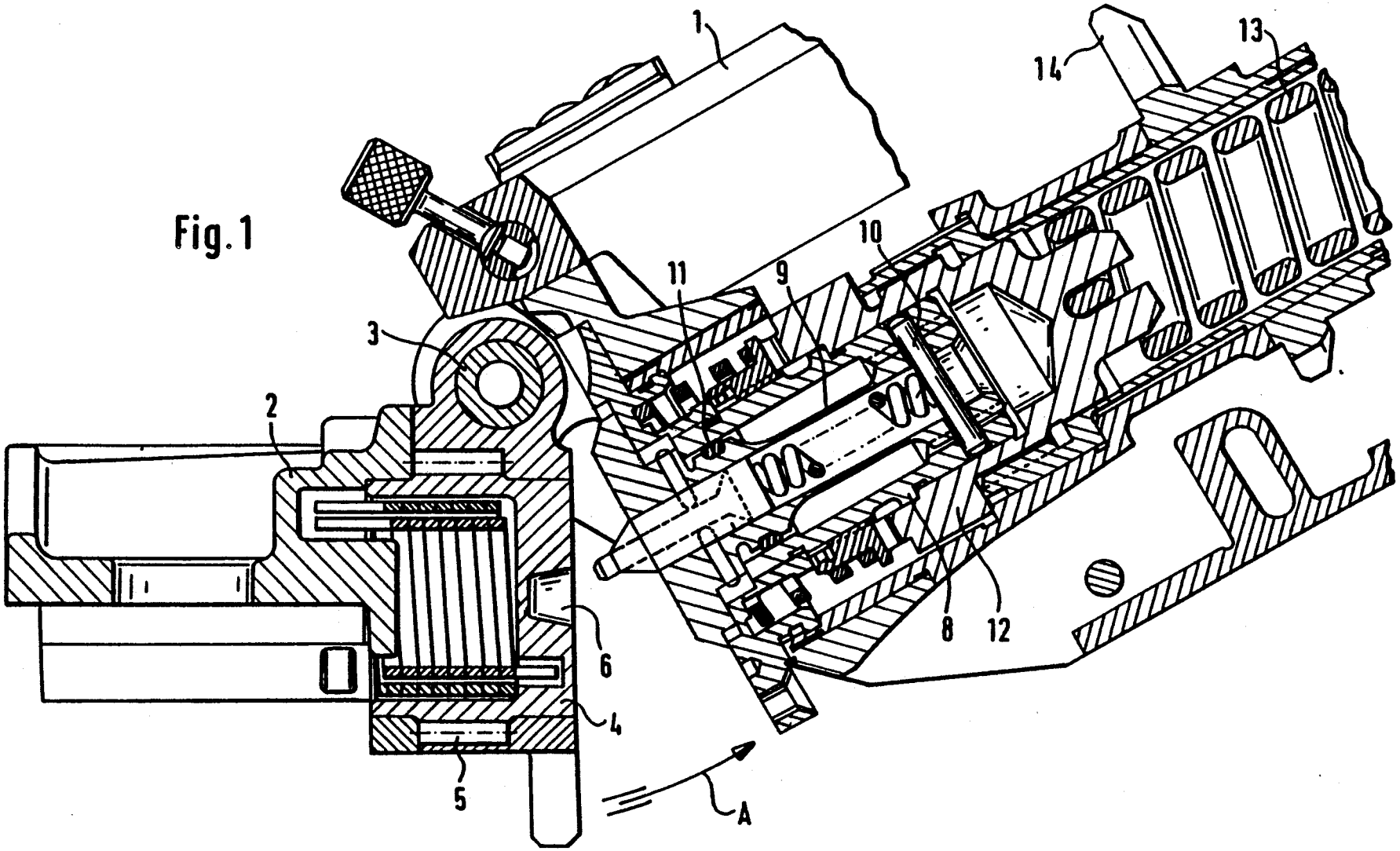
FIG. 1 shows a cartridge feed mechanism in the pivoted-down position according to the present invention.

A cartridge feed mechanism 1 is arranged pivotably about an eye 3 on a drive housing 2. A drive sleeve 4 is mounted rotatably in the drive housing 2. This sleeve 4 has teeth on its circumference, which can be rotated by a plunger (not shown in detail). The gas pressure of the firearm is admitted to the plunger.

The drive sleeve 4 has a coupling groove 6, which extends diagonally on the surface of the drive sleeve 4 facing the cartridge feed mechanism 1.

A sleeve 8 is mounted rotatably in a flange 7 of the cartridge feed mechanism 1. In this sleeve 8, there is mounted a transmission shaft 9 by means of a pin 10, in an oscillating fashion for compensating for the misalignment of the axes. A spring-tensioned ring 11 supports the transmission shaft 9 in the sleeve 8.

The sleeve 8 is provided in connection with a tripping switch mechanism 12 which engages with a driving spring 13. At least one star wheel 14 is rotated for cartridge feed during rotation of the driving spring 13.

The transmission shaft 9 has a coupling tongue 15 that fits into the coupling groove 6 (See FIG. 1).

In FIG. 2, the parts corresponding to those shown in FIG. 1 are designated by the same reference numerals.

The coupling tongue 15 is shown in FIG. 2 in a position rotated through 90° relative to the position shown in FIG. 1.

According to the present invention (see FIG. 2), a slide 16 is mounted in the transmission shaft 9 displaceably and coaxially to the axis of the transmission shaft 9. The slide 16 has a head part 17 of smaller diameter and a foot part 18 of larger diameter. The foot part 18 passes over into said head part 17 in an oblique surface 19. The slide 16 is tensioned by a compression spring 20 at its foot part 18.

Two pins 21 are mounted displaceably in the transmission shaft 9 radially to the shaft. One end 22 of the pin 21 abuts the slide 16. Recesses 24 of the inner circumference of the flange 7 are associated with the other end 23 of the pin 21.

As is apparent from FIGS. 2 and 3, the head part 17 of said slide 16 comes into contact with the bottom of the groove 6 when the feed mechanism is pivoted up. As a result of this, the slide 16 is moved in the direction of arrow (A), and the two pins 21 are able to leave the recesses 24 of said flange 7. The transmission shaft 9 is released for rotation.

In the position shown in the figures, the cartridge feed mechanism 1 is pivoted off from the drive housing 2. Said slide 16 is pushed by said compression spring 20 into its locking position. Its foot part 18 now pushes the pins 21 into the recesses 24. As a result of this, the transmission shaft 9 is locked relative to the fixed flange 7, so that the transmission shaft 9 fails to follow a rotary movement during the manual rotation of the star wheel 14. Consequently, the coupling tongue 15 retains its position.

In the locking position, the head part 17 of the slide 16 projects over said coupling tongue 15. If the cartridge feed mechanism 1 is now rotated to the drive housing 2 opposite the direction of arrow (A), the coupling tongue 15 will find the coupling groove 6, because it has definitely not rotated further relative to the position in which it had left the coupling groove 6 before. At the same time, the head part 17 of the slide 16 comes into contact with the bottom of the coupling groove 6 of the drive sleeve 4. As a result, the slide 16 is pushed back into its releasing position against the force of the compression spring 20. The pins 21 will then slide along said oblique surface 19 onto the foot part 18. They now leave the recesses 24, so that the transmission shaft 9 is now free to be rotated by the drive sleeve 4.

While specific embodiments of the invention have been shown and described in detail to illustrate the application of the principles of the invention, it will be understood that the invention may be embodied otherwise without departing from such principles.

What is claimed is:

1. A cartridge feed arrangement for an automatic firearm, comprising: a drive housing having a drive sleeve with a coupling groove; a cartridge feed mechanism mounted pivotally on said drive housing; a transmission shaft and coupling tongue mounted to said cartridge feed mechanism, said cartridge feed mechanism pivoting into a pivoted-up wherein said coupling tongue engages said coupling groove and pivoting into a pivoted-down position wherein the coupling tongue is disconnected from the coupling groove; and, slide locking means mounted on said cartridge feed mechansim for locking said transmission shaft in a locking position in the pivoted-down position and releasing said transmission shaft in a releasing position in the pivoted-up position, said locking means including a slide member engaging said drive housing to be pushed by said drive housing for establishing said releasing position of said locking means and disengaging from said drive housing for establishing said locking position of said slide locking means.

2. A cartridge feed mechanism according to claim 1, wherein said slide member effects said locking position upon being urged into said locking position by a spring arranged in said cartridge feed mechanism.

3. A cartridge feed mechanism according to claim 1, wherein said slide member is mounted in said transmission shaft and is axially displaceable with respect to said transmission shaft.

4. A cartridge feed mechanism according to claim 1, wherein said slide member includes a head part projecting beyond said coupling tongue, when said transmission shaft is in said locking position.

5. A cartridge feed mechanism according to claim 1, wherein said slide member includes an oblique surface between a base part of large diameter and a head part of smaller diameter, said slide locking means further comprising at least one pin radially displaceably mounted in said transmission shaft having a first end, said first end being in contact with one oblique surface of said slide member when in transition between the locking position and the releasing position, said cartridge feed mechanism including a fixed flange portion defining recesses, said pins being urged by said base part into engagement with said recesses for locking said transmission shaft.

* * * * *